US005543758A

United States Patent [19]

Wey

[11] Patent Number: 5,543,758

[45] Date of Patent: Aug. 6, 1996

[54] ASYMMETRIC DUAL-BAND COMBINE FILTER

[75] Inventor: Chia-Sam Wey, Reno, Nev.

[73] Assignee: Allen Telecom Group, Inc., Solon, Ohio

[21] Appl. No.: 319,523

[22] Filed: Oct. 7, 1994

[51] Int. Cl.[6] ..... H01P 1/20

[52] U.S. Cl. ..... 333/203; 333/202; 333/222

[58] Field of Search ..... 333/202, 203, 333/219, 222, 226

[56] References Cited

U.S. PATENT DOCUMENTS

| | | | |
|---|---|---|---|
| 3,818,389 | 6/1974 | Fisher | 333/203 |
| 4,037,182 | 7/1977 | Burnett et al. | 333/203 |
| 4,937,533 | 6/1990 | Livingston | 333/203 |
| 4,990,869 | 2/1991 | Chanteau et al. | 333/203 |
| 5,023,579 | 6/1991 | Bentivenga et al. | 333/203 |
| 5,131,670 | 9/1992 | Blair et al. | 333/203 |
| 5,262,742 | 11/1993 | Bentivenga | 333/203 |
| 5,327,108 | 7/1994 | Hoang et al. | 333/203 |
| 5,329,687 | 7/1994 | Scott et al. | 333/202 |
| 5,389,903 | 2/1995 | Piirainen | 333/203 |
| 5,410,284 | 4/1995 | Jachowski | 333/203 |

*Primary Examiner*—Benny Lee
*Assistant Examiner*—Darius C. Gambino
*Attorney, Agent, or Firm*—Laff, Whitesel, Conte & Saret, Ltd.

[57] ABSTRACT

A dual-band filter providing a bandpass characteristic over a first predetermined range of frequencies, and a notch, or band-reject characteristic over a second predetermined range of frequencies. In one embodiment, the notch characteristic occurs within the bandpass characteristic, yielding a filter frequency response with two asymmetric passbands separated by a reject band. This is particularly suited to cellular Band A receive filter applications, but the design is easily adapted to other uses. Appropriate tuning can restore symmetry to the passbands.

27 Claims, 5 Drawing Sheets

ASYMMETRIC DUAL-BAND COMBINE FILTER

FIELD OF THE INVENTION

This invention relates generally to bandpass filters, and in particular to a dual-band bandpass filter, and is more particularly directed toward an integrated bandpass filter and notch filter that functions as a dual-band filter.

BACKGROUND OF THE INVENTION

When cellular communication systems were first introduced under the Advanced Mobile Phone Service, Inc. (AMPS), separate sections of the available spectrum were allocated to wireline carriers (telephone companies) and non-wireline carriers (other communication providers who were not then involved in telephone communication). Of course, when the AMPS specification was first published, in March of 1981, it was presumed that cellular service providers would be primarily telephone companies, with other radio common carriers (RCC's) making up the balance. Existing RCC's were principally involved in conventional two-way systems, paging, and trunked communication.

The original allocation plan called for a large section of radio frequency (RF) spectrum to be allocated to cellular communication, covering two ranges of frequencies offset by 45 MHz (megahertz). The frequency offset was designed to support full-duplex communication, so that communicating parties could both talk and listen at the same time. This was necessary, of course, so that cellular communication would approximate landline telephone communication as closely as possible.

A range of frequencies from about 870 MHz to around 890 MHz was set aside for "forward" channels. By forward, the drafters of the AMPS spec meant communication occurring in what they termed a forward direction: from base stations to mobile or portable cellular telephones. The frequencies set aside for "reverse" communication (from cellular mobiles or portables back to base site equipment) were offset by 45 MHz as mentioned above, and ranged between about 825 MHz and 845 MHz. These frequency bands were arranged in 666 RF channels, each 30 KHz (kilohertz) apart, much as represented in FIG. 1. Wireline carriers were assigned the lower 333 channels, designated as Band A, while non-wireline carriers were assigned the upper 333 channels. This division of spectrum was conceived largely on the presumption that there would be two competing cellular systems in most markets. As illustrated in the figure, there was reserved spectrum at each end of both sections of allocated spectrum.

In the design of RF receivers, it is common practice to provide filtering in the receiver "front-end" to reject signals that fall outside the frequency band of interest. For a cellular carrier in Band A, for example, it would be appropriate to provide a bandpass filter in the receiver front-end that would pass the Band A channels, while rejecting everything outside that range. Filters meeting these general requirements were easily provided using conventional bandpass filter technology.

Unfortunately, as cellular popularity boomed, the clamor for more communication channels was not met by the foreseen spectrum expansion that would have simply extended Band A and Band B at their upper and lower limits, respectively. Instead, Band A was extended by adding 1 Mhz of spectrum just below the A Band (from 824 to 825 MHz), and another 1.5 MHz just above the B Band (from about 845 to 846.5 MHz). The B Band extension was similarly discontinuous, but was accomplished by adding a single section of RF spectrum, from 846.5 MHz to 849 MHz. Of course, the new frequencies just mentioned are for reverse channels. Similar segments were added, 45 MHz away, for forward channel expansion. The results of this cellular spectrum expansion are illustrated in FIG. 2.

The greatest impact of this segmented expansion plan was felt in the design of filters for A Band receivers. Although the B Band was also segmented, there is only a 1.5 MHz gap between B Band spectrum sections. Consequently, a high-Q ceramic notch filter cascaded with a conventional bandpass filter adequately solves the filtering dilemma, without introducing insurmountable design problems. The A Band situation, however, is somewhat different.

Since the disparate segments of Band A are separated by a 10 MHz gap, it is difficult to cascade bandpass and band reject filters to meet the necessary specifications without meeting interaction problems related to impedance mismatch and phase distortion. Consequently, a need arises for a filter that integrates the desired bandpass and band reject (or notch) characteristics into a single filter, so that problems with filter interaction can be minimized and costs can be reduced.

SUMMARY OF THE INVENTION

These needs and others are satisfied by the filter of the present invention, in which an RF filter having an input and an output with a forward signal path therebetween, and exhibiting a predetermined frequency response, is provided. The filter includes a plurality of pole resonators disposed along the forward signal path, and a plurality of zero resonators outside the forward signal path, where each zero resonator is coupled to a corresponding one of the plurality of pole resonators. The filter frequency response consequently exhibits a bandpass characteristic over a first predetermined range of frequencies, with a notch characteristic over a second predetermined range of frequencies. In the preferred embodiment, the second predetermined range of frequencies is within the frequency range spanned by the first predetermined range of frequencies.

In one embodiment, each of the plurality of pole resonators contributes a pole to the frequency response of the filter, while each of the zero resonators contributes both a zero and a pole to the frequency response. Each of the poles contributed by the zero resonators has a magnitude substantially equal to that of the poles contributed by the pole resonators.

BRIEF DESCRIPTION OF THE DRAWINGS

FIG. 3(*b*) is a section view along section line 3(*b*)—3(*b*) of FIG. 3(*a*), illustrating the input pole resonator, input connector, and resonator mounting detail;

FIG. 3(*c*) is a perspective view of the housing cover depicting tuning screw placement;

DESCRIPTION OF A PREFERRED EMBODIMENT

The inventor has developed a reliable, economical dual-band filter that avoids interaction pitfalls that commonly arise when multiple filters are cascaded to achieve a desired frequency response characteristic. The filter was devised for use in the cellular communication spectrum, although it is by no means limited to particular frequencies. The invention can best be understood with reference to the accompanying drawing figures.

Figure 1:
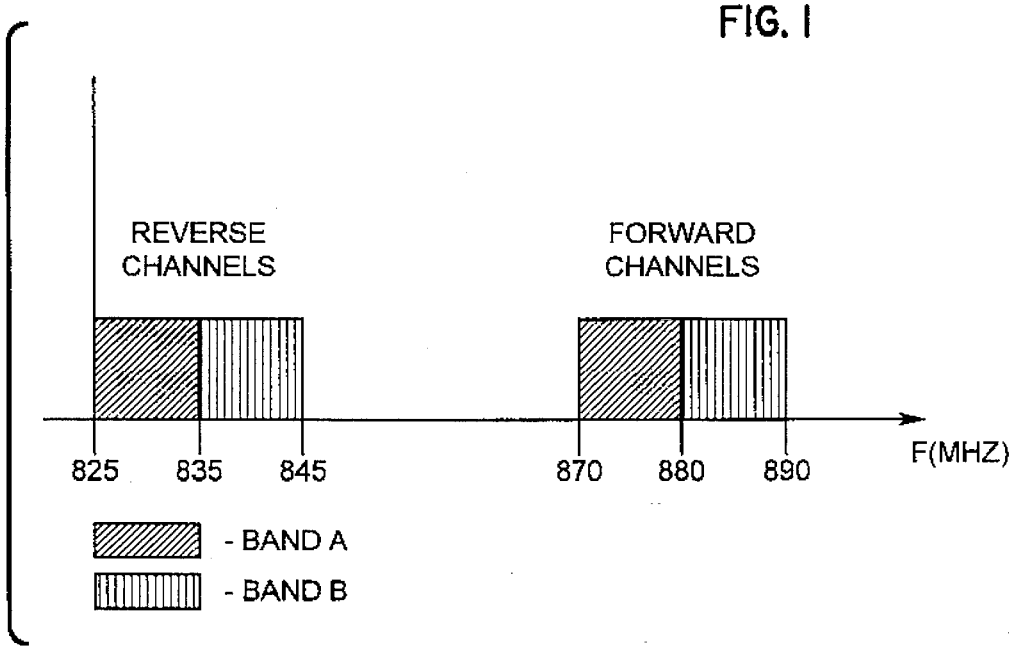
FIG. 1 illustrates original AMPS system cellular spectrum assignment.
Figure 2:
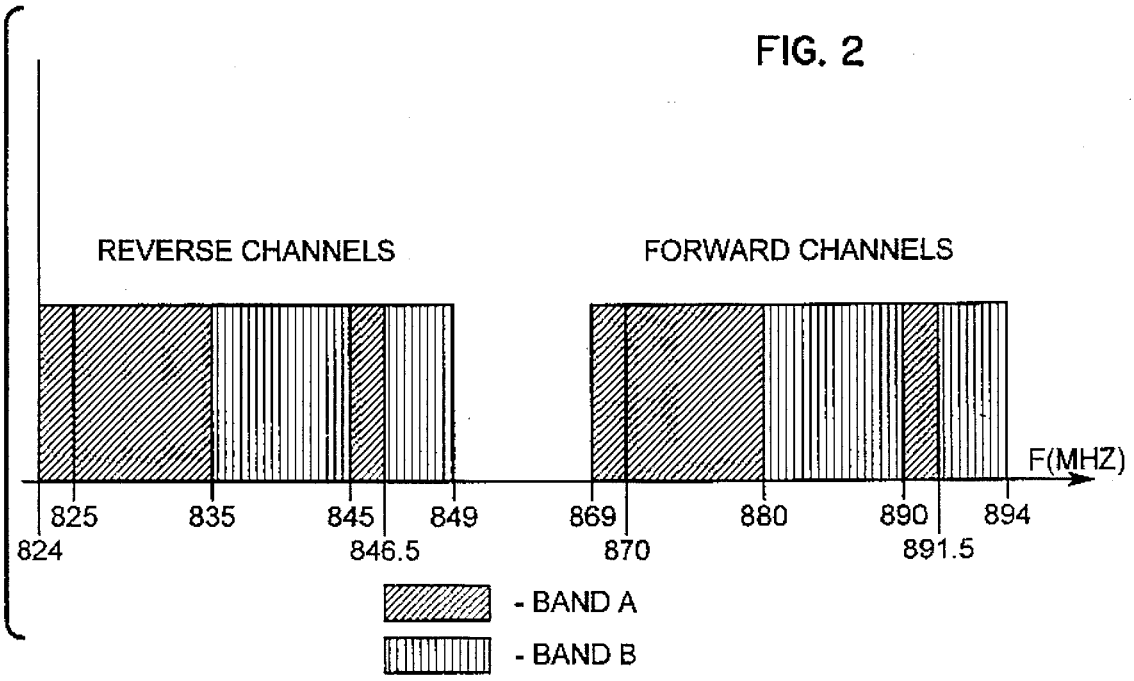
FIG. 2 depicts the manner in which assigned cellular spectrum has been expanded.
Figure 3A:
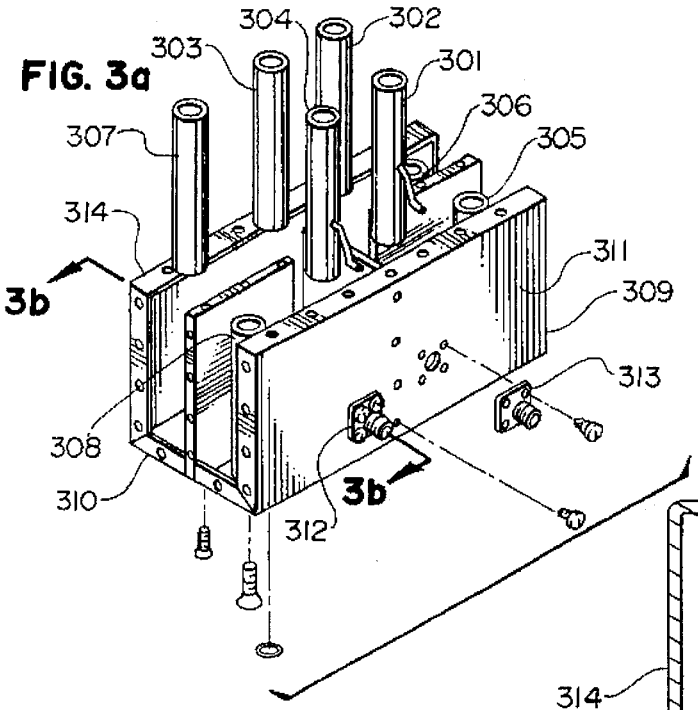
FIG. 3(*a*) is a perspective view of a dual-band filter in accordance with the present invention, illustrating resonator placement.
Figure 3B:
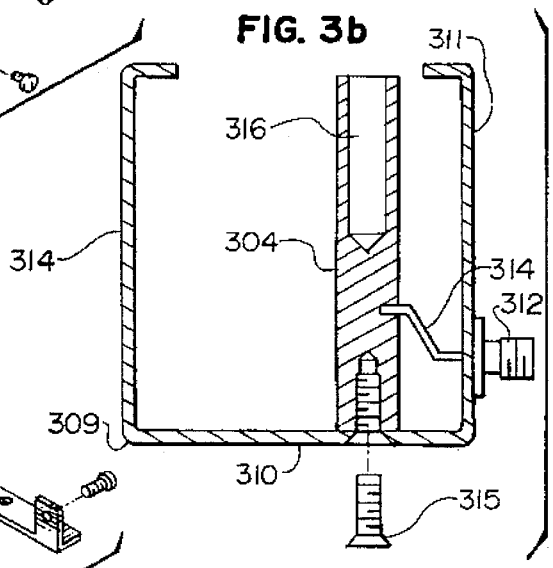
Figure 3C:
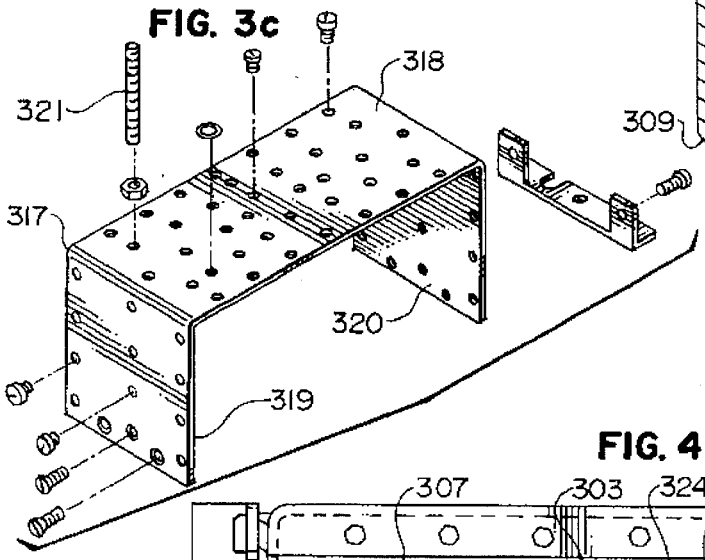

Filters constructed using coupled resonators are generally known, although the present invention incorporates several new features that enable the inventive filter to yield the desired frequency response characteristic in a fashion that distinguishes its design and performance over filters previously known in the art. FIG. 3(*a*) is a perspective view of a dual-band filter in accordance with the present invention. A plurality of pole resonators (301–304), so named because these resonators contribute poles to the frequency response of the resulting filter, are constructed in an elongate, rod-like shape, in a fashion that will be discussed in more detail in a subsequent section. These resonators (301–304) are disposed in a generally rectangular arrangement, or array, as depicted in FIG. 3, and mounted to the bottom portion (310) of a generally rectangular housing (309). The housing (309) is formed from a conductive material, and may be fabricated of silver-plated aluminum, for example. A plurality of zero resonators (305–308) that contribute zeros to the filter frequency response are also disposed in a generally rectangular arrangement, and are mounted to the housing bottom (310). The rectangle formed by the positions of the zero resonators (305–308) is larger than the rectangle formed by the arrangement of the pole resonators (301–304), and can consequently be termed external to the rectangular arrangement of the pole resonators (301–304). The zero resonators (305–308) are positioned such that each of the plurality of zero resonators (305–308) is coupled to a corresponding one of the plurality of pole resonators (301–305). For example, pole resonator 301 is coupled to zero resonator 305, pole resonator 302 is coupled to zero resonator 306, and so on, with each zero resonator coupled to the pole resonator at the corresponding rectangular vertex. As will be seen in the discussion that follows, the zero resonators contribute not only zeros to the frequency response characteristic of the filter, but poles as well.

One of the pole resonators (304) is designated as the output pole resonator, and is coupled to an output connector (312) that is mounted to one of the sidewalls (311) of the housing (309). The housing (309) has two sidewalls (311, 314) that are generally perpendicular to the housing bottom portion (310). Coupling of the output connector (312) to the output pole resonator (304) is accomplished in a way that will be treated in more detail in the discussion accompanying FIG. 3(*b*). In a similar fashion, also to be discussed in more detail later, an input connector (313) is mounted to the housing sidewall (311) and coupled to a designated input pole resonator (301). Coupling of the connectors occurs through the connector center conductors. Of course, since the filter described above is a reciprocal filter, either of the resonators in proximity to the input and output connectors could be designated as either an input or output pole resonator. The specific direction of the forward signal path is selected as a matter of convenience.

FIG. 3(*b*) is a section view along section line 3(*b*)—(*b*) of FIG. 3(*a*). This section view clearly depicts the housing (309), illustrating the bottom portion (310) to which the output pole resonator (304) is mounted. In the preferred embodiment, the resonator (304) is securely mounted to the bottom portion (310) by a mounting screw (315), but other methods of securing the resonators in place, such as soldering, casting, etc., may also be used. Other details that should properly appear in this section view have been omitted for the sake of clarity. The view of FIG. 3(*b*) shows the center conductor (314) of the output connector (312) connected to the output pole resonator (304) at a suitable position along the resonator's length. Of course, selection of this position is determined largely by the design output impedance of the filter. In a similar fashion, the input pole resonator (301) is connected to the input connector (313), with impedance considerations dictating the suitable connection point along the input resonator's length.

The output resonator (304) depicted in FIG. 3(*b*) includes an evacuated cylindrical portion (316) at a point distal from the mounting end that is affixed to the housing bottom (310). This evacuated portion (316) is designed to accept a tuning screw that can be moved in and out to adjust the resonant frequency of the resonator (304). The tuning screw, of course, should not make physical contact with the resonator, itself. Preferably, all of the resonators (301–308) are provided with these evacuated portions and equipped with tuning screws for frequency adjustment.

FIG. 3(*c*) depicts the housing cover (317), that includes a top portion (318) and endwalls (319, 320) that are formed to be generally perpendicular to the top (318). A tuning screw (321) is illustrated penetrating the top portion (318) in a suitable position to provide frequency adjustment for one of the pole resonators (307). Tuning screws are provided for each resonator, but are not shown in the figure for the sake of clarity. A coupling adjustment mechanism, perhaps in the form of coupling adjustment screws, may be added to the filter to expand filter adjustment capability, although no coupling adjustments are shown in the figure for clarity's sake. The housing cover (317) and the housing (309) are designed to mate securely to completely enclose the filter.

Figure 4:
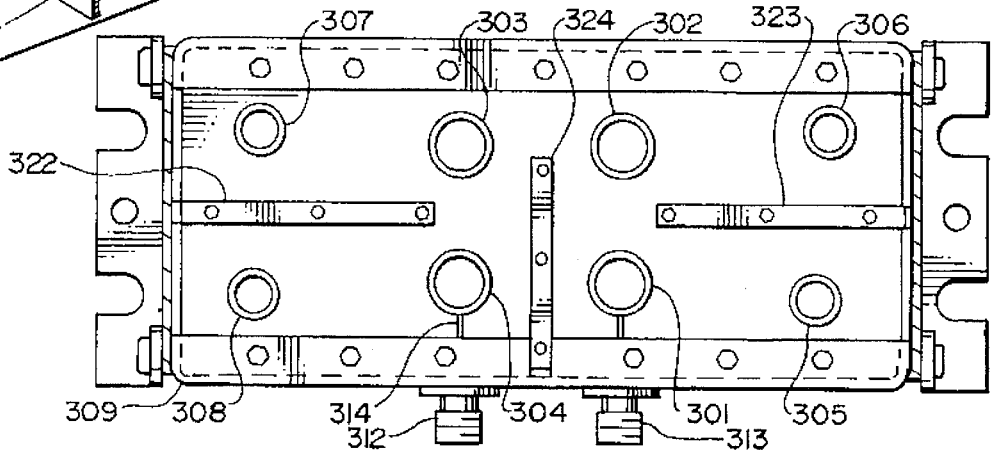
FIG. 4 is a top plan view of a dual-band filter in accordance with the present invention.
Figure 5:
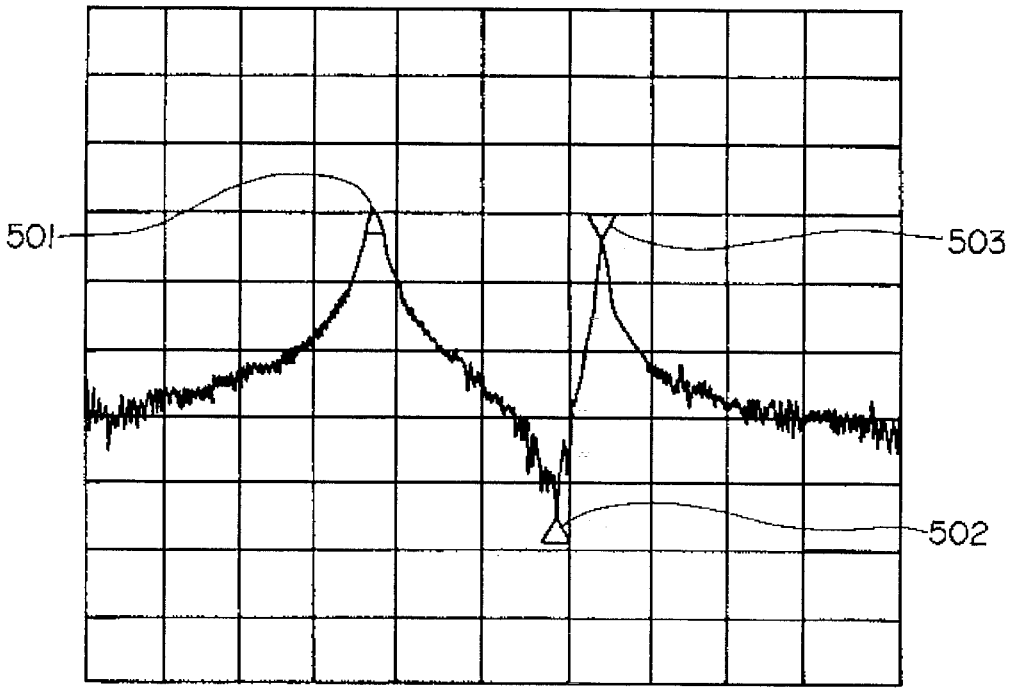
FIG. 5 shows the frequency response characteristic of a pole resonator and a corresponding zero resonator, to which the pole resonator is coupled, when both resonators are tuned into the filter passband with the remaining resonators detuned.

FIG. 4 is a top plan view of a filter in accordance with the present invention, and illustrates a plurality of dividing walls (322–324) that are electrically and mechanically connected to the housing (309) for the purpose of providing isolation and decoupling. A discussion of signal paths through the filter will best serve to illustrate the function of these dividing walls (322–324).

In operation, an input signal is applied to the filter input connector (313) and coupled to the input pole resonator (301). From this point, the signal couples to a proximate second pole resonator (302). As mentioned previously, it may be advantageous for some applications to provide a coupling adjustment mechanism for the purpose of adjusting coupling between resonators, but such coupling mechanisms are not shown here. Simple adjusting screws penetrating the space between resonators where coupling is sought to be adjusted would serve adequately, and other arrangements, known in the art, are also possible.

The signal couples in turn to a third pole resonator (303), and finally to the output pole resonator (304). Note that the zero resonators (305–308) are deliberately spaced farther apart than the pole resonators, so that the zero resonators do not form a part of the primary forward signal path, defined by the arrangement of the pole resonators (301–304). As mentioned above, each pole resonator is coupled to a corresponding zero resonator, but coupling between adjacent zero resonators is foreclosed by the dividing wall arrangement. For example, a dividing wall section (323) positioned between a first zero resonator (305) and a second zero resonator (306) provides necessary isolation between these zero resonators. In a similar fashion, another dividing wall section (322), positioned at the opposite end of the to filter, obviates coupling between zero resonators 307 and 308. Yet another section of dividing wall (324) is arranged to prevent coupling among the pole resonators except along the design forward signal path; that is, from the input connector (313) through the pole resonators, in the order 301, 302,303, and 304, and thence to the output connector (312).

As discussed briefly in a previous section, the zero resonators are designed to contribute both a zero and a pole to the filter frequency response, and the discussion of filter operation and tuning in the subsequent sections should promote understanding of this feature. A satisfactory method for beginning a tuning operation is to "detune" all of the resonators, so that none of their poles or zeros appear within the design bandwidth. This tends to minimize resonator interactions that can make tuning difficult. Other methods of tuning a filter of this type are, of course, possible.

Using the preferred method, a first pole resonator other than the input or output pole resonator (in this case, pole resonator 302) is tuned so that it's pole (501) lies within the design bandwidth. The associated zero resonator (306) is then tuned to place it's zero within the design bandwidth (502). The action of tuning the zero resonator (306) also brings in another pole (503) associated with the zero resonator (306), and having a magnitude comparable to that of the pole (501) provided by the pole resonator (302). The action of tuning the zero resonator also shifts the initial position of the pole (501) provided by the pole resonator (302). This is one reason why tuning procedures are largely iterative and can vary widely while accomplishing the same result; resonator interaction during the tuning process makes it necessary to repeat certain tuning steps to achieve the design frequency response, often many times.

Figure 6:
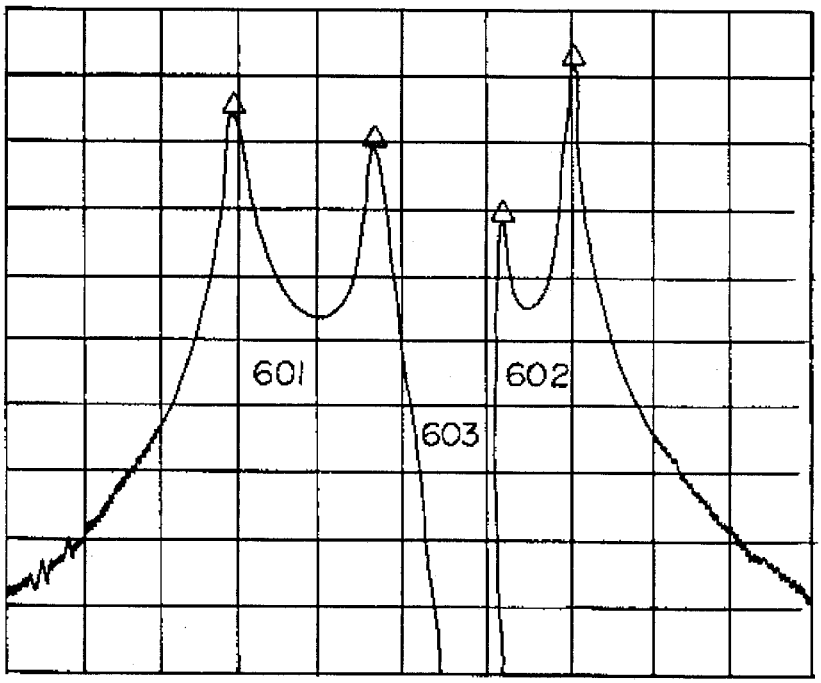
FIG. 6 illustrates the effect when two pole resonators, and the zero resonators to which they are coupled, are tuned into the filter passband.

Next, the remaining pole resonator that is not an input or output pole resonator (pole resonator 303, in this example) is tuned into the design frequency response characteristic, followed by tuning its associated zero resonator (307). Just as in the previous example, this part of the tuning process brings in not only the pole associated with pole resonator 303, but the pole and zero associated with zero resonator 307. The resulting frequency response characteristic is depicted generally in FIG. 6. There are now two bandpass regions (601, 602), albeit displaying considerable passband ripple, with an intervening band reject portion (603).

Figure 7:
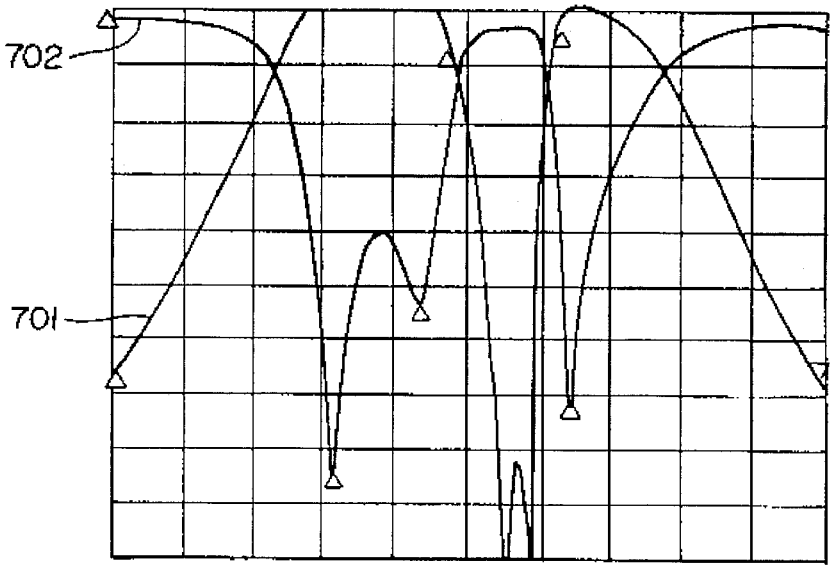
FIG. 7 illustrates the effect when the input and output pole resonators are tuned into the passband of the filter.

At this point, the input and output pole resonators (301, 304) are tuned in to smooth the passband ripple effect. This is illustrated in FIG. 7 by frequency response characteristic 701. A return loss characteristic (702) is also shown, illustrating excellent return loss performance even at this stage of the tuning procedure. Of course, if return loss performance were part of the filter specification, filter tuning can be adjusted with that in mind, as well as the frequency response performance. Of course, passband and reject band insertion loss are also generally important parameters.

Figure 8:
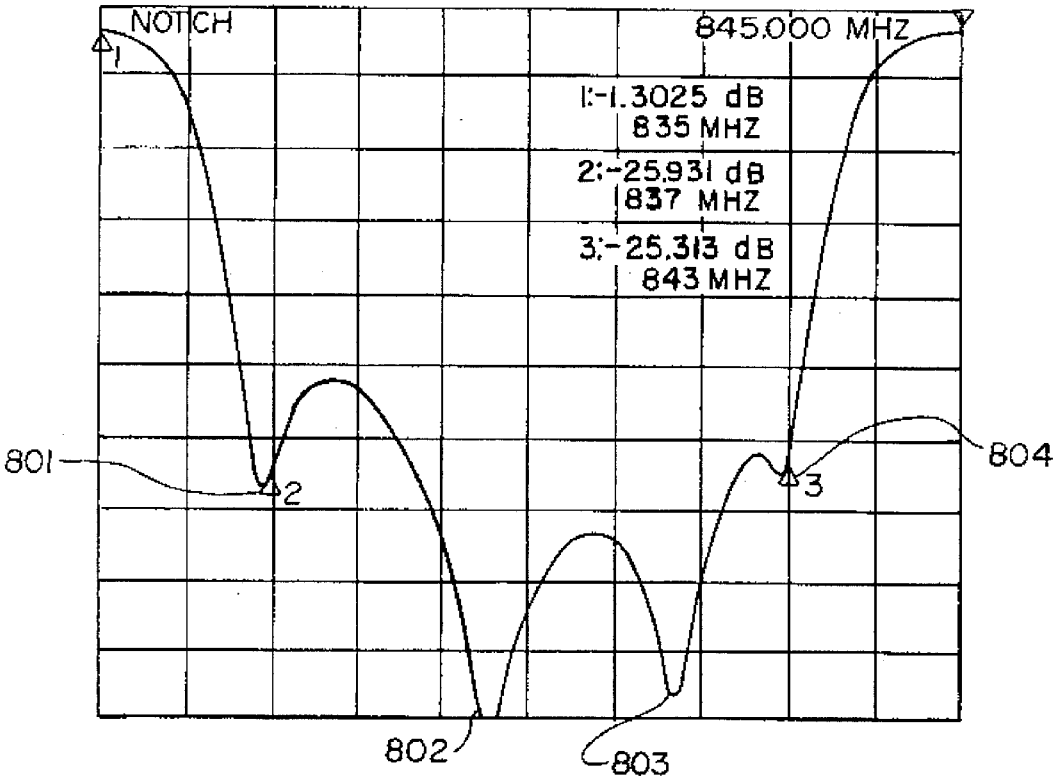
FIG. 8 is an expanded view of the stopband response of a filter in accordance with the present invention.

FIG. 8 is an expanded view of the band reject (or notch) portion of the filter response. The zeros at the edges of the reject band (801, 804) are provided by tuning in the zero resonators (305 and 308, respectively) that are associated with the input and output pole resonators (301, 304). This adjustment is made to widen the reject band. The other zero resonators (306 and 307) are tuned so that their zeros (803 and 802, respectively) fall near the center of the reject band.

Figure 9:
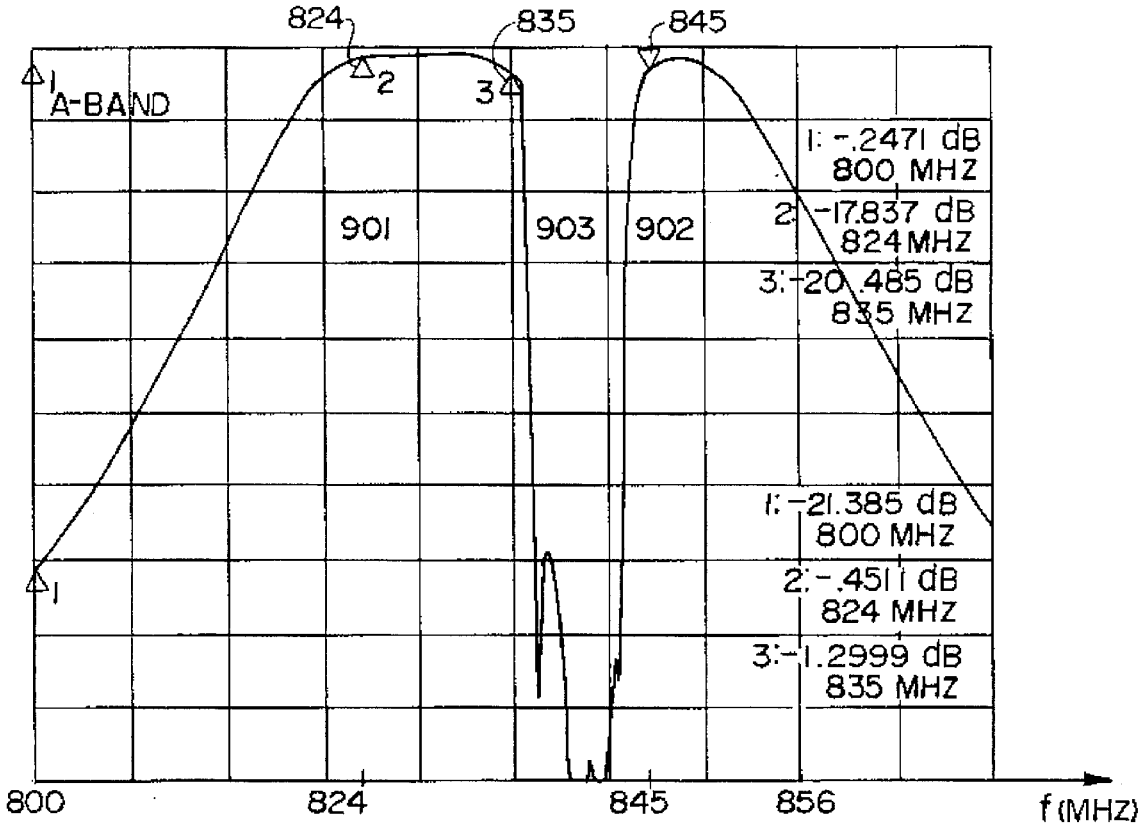
FIG. 9 is the complete frequency response of an asymmetric dual-band filter in accordance with the present invention.

The final form of the filter frequency response characteristic is shown in FIG. 9. As illustrated in the figure, the filter has a general bandpass characteristic, as represented by bandpass sections 901 and 902, over a first predetermined range of frequencies, with that range extending from about 820 MHz to around 850 MHz. Over a second predetermined range of frequencies, the filter displays a notch, or band reject, characteristic (903), with the notch characteristic ranging from about 837 to about 843 MHz. In this embodiment, the second range of frequencies is a subset of the first range of frequencies. Also, the notch portion is not positioned symmetrically with respect to the bandpass portions of the characteristic. In other words, the first bandpass portion (902) is larger than the second bandpass portion (902). Of course, the pole and zero resonators could be tuned to yield a symmetric response, if the specific filter application made it necessary.

The inventor has described herein an asymmetric dual-band filter that is relatively economical to produce when compared with common prior art solutions, easily adapted for specific applications, and free of interaction problems that occur in multiple filter approaches. It will be apparent to those skilled in the art that modifications may be made without departing from the spirit and scope of the invention. Accordingly, it is not intended that the invention be limited except as may be necessary in view of the appended claims.

What is claimed is:

1. An RF filter having an input and an output with a forward signal path therebetween, and exhibiting a predetermined frequency response, the filter comprising:

a plurality of pole resonators disposed along the forward signal path; and a plurality of zero resonators outside the forward signal path, wherein each zero resonator is coupled to a corresponding one of the plurality of pole resonators such that the filter frequency response exhibits a bandpass characteristic over a first predetermined range of frequencies, with a notch characteristic over a second predetermined range of frequencies.

2. The RF filter of claim 1, wherein one of the plurality of pole resonators is designated as an input pole resonator, and is coupled to the filter input.

3. The RF filter of claim 1, wherein one of the plurality of pole resonators is designated as an output pole resonator, and is coupled to the filter output.

4. The RF filter of claim 1, wherein the pole resonators are disposed in a generally rectangular arrangement.

5. The RF filter of claim 4, wherein the zero resonators are disposed in a generally rectangular arrangement.

6. The RF filter of claim 5, wherein the rectangular arrangement of the zero resonators is external to the rectangular arrangement of the pole resonators.

7. The RF filter of claim 1, wherein the pole resonators and the zero resonators are rod-like in shape, and generally circular in transverse cross-section.

8. The RF filter of claim 1, further including a housing having a bottom, and opposing side walls generally perpendicular thereto.

9. The RF filter of claim 8, wherein the filter further includes input and output connectors mounted to the side walls.

10. The RF filter of claim 9, wherein the input connector includes a center conductor that is connected to the input pole resonator at a position selected to provide a predetermined filter input impedance.

11. The RF filter of claim 9, wherein the output connector includes a center conductor that is connected to the output pole resonator at a position selected to provide a predetermined filter output impedance.

12. The RF filter of claim 8, wherein the pole resonators and the zero resonators are mounted to the bottom of the housing.

13. The RF filter of claim 8, further including a housing cover having a top, and opposing end walls generally perpendicular thereto.

14. The RF filter of claim 13, wherein the housing and the housing cover mate to completely enclose the filter.

15. The RF filter of claim 13, wherein the pole resonators and the zero resonators include evacuated cylindrical portions at ends distal from the housing bottom, and tuning screws are disposed on the housing top such that the tuning screws penetrate the evacuated cylindrical portions of the resonators without making physical contact with the resonators.

16. The RF filter of claim 1, wherein the second predetermined range of frequencies is a subset of the first predetermined range of frequencies.

17. The RF filter of claim 1, wherein each of the plurality of pole resonators contributes a pole to the frequency response of the filter.

18. The RF filter of claim 17, wherein each of the plurality of zero resonators contributes both a zero and a pole to the frequency response of the filter.

19. The RF filter of claim 18, wherein the pole contributed by each of the plurality of zero resonators is substantially equal in magnitude to the pole contributed by each of the plurality of pole resonators.

20. An RF filter exhibiting a predetermined frequency response, the filter comprising:

a housing having top, bottom, and side portions;

a plurality of pole resonators mounted to the bottom portion, and disposed in a rectangular arrangement to provide a forward signal path from a designated input pole resonator to a designated output pole resonator;

input and output connectors, each mounted to a side portion, with the input connector and the output connector coupled to the input pole resonator and the output pole resonator, respectively;

a plurality of zero resonators mounted to the bottom portion, each being coupled to a corresponding pole resonator, and disposed in a rectangular arrangement external to the rectangular arrangement of the pole resonators;

such that the filter frequency response exhibits a bandpass characteristic over a first predetermined range of frequencies, with a notch characteristic over a second predetermined range of frequencies.

21. The RF filter of claim 20, wherein the second predetermined range of frequencies is a subset of the first predetermined range of frequencies.

22. The RF filter of claim 20, wherein the input and output connectors include center conductors that are coupled to the input and output pole resonators, respectively, by attaching the center conductors to the resonators at suitable positions.

23. The RF filter of claim 20, wherein the housing includes a plurality of dividing walls that are electrically and mechanically connected to the housing to provide isolation and decoupling.

24. The RF filter of claim 20, wherein each of the plurality of pole resonators contributes a pole to the frequency response of the filter.

25. The RF filter of claim 24, wherein each of the plurality of zero resonators contributes both a zero and a pole to the frequency response of the filter.

26. The RF filter of claim 25, wherein the pole contributed by each of the plurality of zero resonators is substantially equal in magnitude to the pole contributed by each of the plurality of pole resonators.

27. An RF filter comprising:

a housing including a bottom with opposing sidewalls generally perpendicular thereto, and a cover having opposing endwalls generally perpendicular thereto, such that the housing bottom and the housing cover mate to substantially enclose the filter;

input and output connectors having center conductors, the input and output connectors each mounted to a sidewall of the housing;

a plurality of elongated pole resonators generally circular in transverse cross-section mounted to the bottom of the housing, with one of the pole resonators designated as the input pole resonator and connected to the center conductor of the input connector, and another of the pole resonators designated as the output pole resonator and connected to the center conductor of the output connector, wherein the pole resonators are disposed in a generally rectangular arrangement to provide a forward signal path between the input connector and the output connector;

a plurality of zero resonators coupled to the plurality of pole resonators and disposed in a generally rectangular arrangement that is external to the rectangular arrangement of the pole resonators;

a plurality of tuning screws disposed on the housing cover and suitably positioned to penetrate evacuated cylindrical regions of the pole and zero resonators without making physical contact with the resonators;

such that the filter exhibits a frequency response including a bandpass characteristic over a frequency range extending from a first predetermined frequency to a second predetermined frequency, and a notch characteristic over a range of frequencies extending from a third predetermined frequency to a fourth predetermined frequency, wherein the third predetermined frequency is greater than the first predetermined frequency and the fourth predetermined frequency is less than the second predetermined frequency;

wherein each of the plurality of pole resonators contributes a pole to the frequency response of the filter, and each of the plurality of zero resonators contributes both a zero and a pole to the frequency response of the filter, wherein the pole contributed by each of the plurality of zero resonators is substantially equal in magnitude to the pole contributed by each of the plurality of pole resonators.

* * * * *

UNITED STATES PATENT AND TRADEMARK OFFICE

CERTIFICATE OF CORRECTION

PATENT NO. : 5,543,758
DATED : August 6, 1996
INVENTOR(S) : Chia-Sam Wey

It is certified that error appears in the above-indentified patent and that said Letters Patent is hereby corrected as shown below:

On the title page, item [54] and column 1, line 1, delete "Combine" and insert --Combline--.

Signed and Sealed this

Twenty-ninth Day of October 1996

*Attest:*

BRUCE LEHMAN

*Attesting Officer*

*Commissioner of Patents and Trademarks*